US005642979A

United States Patent [19]

Cullen et al.

[11] Patent Number: 5,642,979

[45] Date of Patent: *Jul. 1, 1997

[54] ROLL HANDLING APPARATUS FOR FORK LIFT TRUCKS

[75] Inventors: Ralph E. Cullen, Arden Hills; John Robert Sjolund, Crosslake, both of Minn.

[73] Assignee: N.R.S. Systems, Inc., Crosslake, Minn.

[ * ] Notice: The term of this patent shall not extend beyond the expiration date of Pat. No. 5,513,944.

[21] Appl. No.: 591,216

[22] Filed: Jan. 17, 1996

Related U.S. Application Data

[63] Continuation-in-part of Ser. No. 370,370, Jan. 9, 1995, Pat. No. 5,513,944.

[51] Int. Cl.[6] ..... B66F 9/18

[52] U.S. Cl. ..... 414/607; 414/626; 414/620; 414/908; 414/911; 294/67.5; 294/97

[58] Field of Search ..... 414/607, 620, 414/626, 684, 619, 908, 910, 911; 294/67.2, 67.5, 97

[56] References Cited

U.S. PATENT DOCUMENTS

| | | | |
|---|---|---|---|
| 2,680,644 | 3/1954 | Marconi | 294/67.2 |
| 2,803,363 | 9/1957 | Hutchinson | 414/911 |
| 2,951,725 | 9/1960 | St. Jean | 294/97 |
| 3,075,664 | 1/1963 | Collings | 414/626 |
| 3,195,751 | 7/1965 | Meyers et al. | 414/607 |
| 3,251,623 | 5/1966 | Fredholm | 294/97 |
| 3,319,815 | 5/1967 | Vik | 414/607 |
| 3,409,156 | 11/1968 | Mills | 414/607 |
| 3,436,116 | 4/1969 | Anderson | 414/626 |
| 3,730,368 | 5/1973 | Dalglish | 414/621 |
| 3,734,328 | 5/1973 | Dalglish | 414/620 |
| 3,758,144 | 9/1973 | Dalglish | 294/64.1 |
| 4,154,470 | 5/1979 | Dalglish | 294/93 |
| 4,318,661 | 3/1982 | Helm | 414/607 |
| 4,358,143 | 11/1982 | Cullen | 294/64.1 |
| 4,708,574 | 11/1987 | Conboy et al. | 414/626 |
| 5,513,944 | 5/1996 | Cullen et al. | 414/607 |

FOREIGN PATENT DOCUMENTS

| | | | |
|---|---|---|---|
| B31954 | 5/1956 | Germany | 414/626 |
| 952746 | 10/1956 | Germany | 414/626 |

*Primary Examiner*—Karen B. Merritt
*Assistant Examiner*—Stephen Gordon

[57] ABSTRACT

Converts any fork lift truck to a roll turning fork truck by sliding a specially designed rectangular frame onto the truck forks. A safety chain is incorporated to firmly attach the device to the fork lift carriage. The frame combines a power hoist, with load sensing brake, and cable that engages a roll or coil core via a roll center lift, which continuously grips the core firmly, in combination with an arm proceeding out from the roll center lift to the outside mid-width of the roll or coil which is attached to an adjustable fixed length chain. By lowering or raising the hoist cable past the fixed length chain, rolls can be turned to either a true horizontal or vertical position. The adjustable "L" frame suspends from the fixed length chain at the lowest point with a pivot pin to achieve the turning feature when the hoist cable is activated. Even though a fork truck may be stationary, the center lift is free to guide into the roll because the roll center lift is connected to a flexible cable and flexible chain.

1 Claim, 8 Drawing Sheets

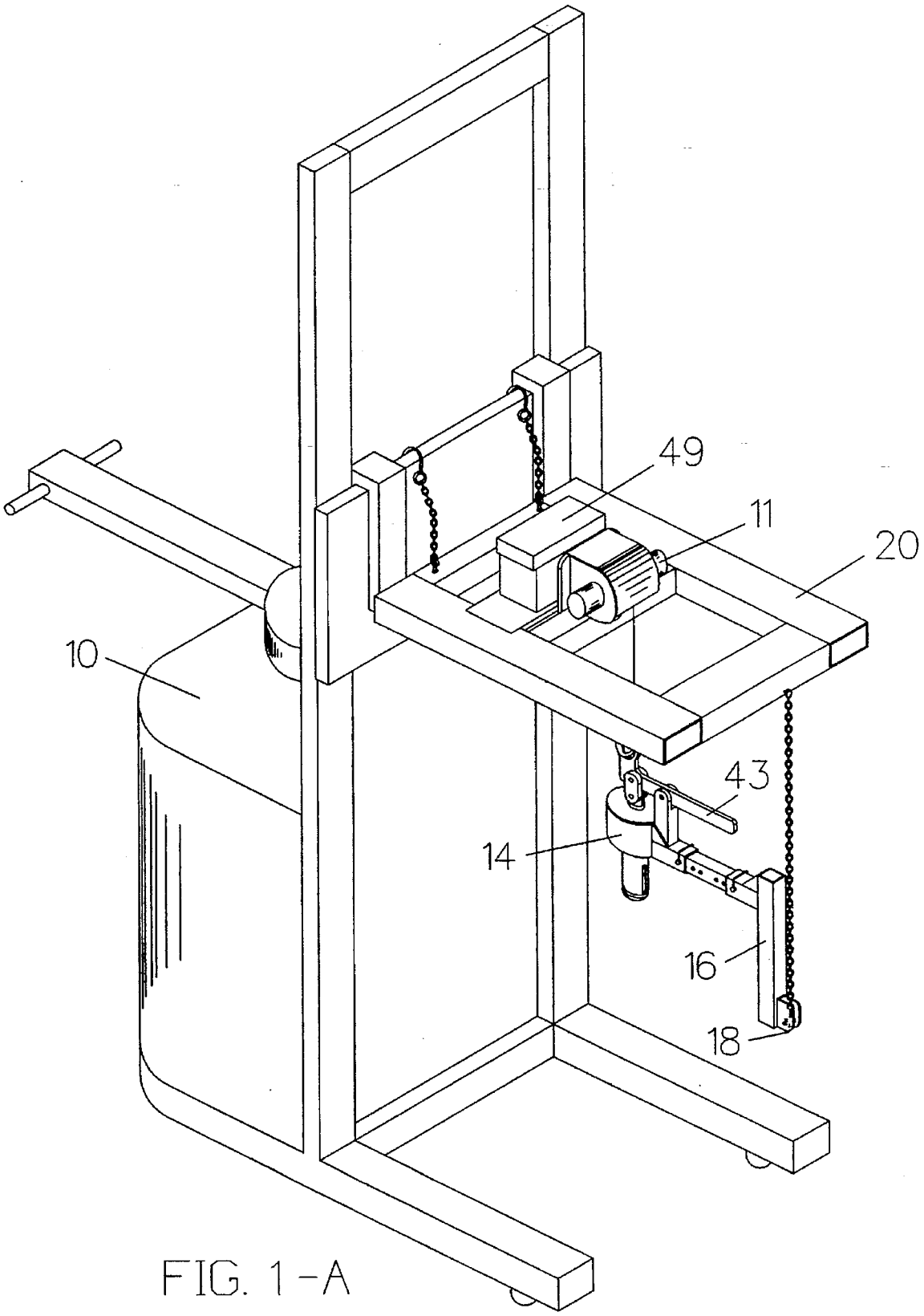
FIG. 1-A

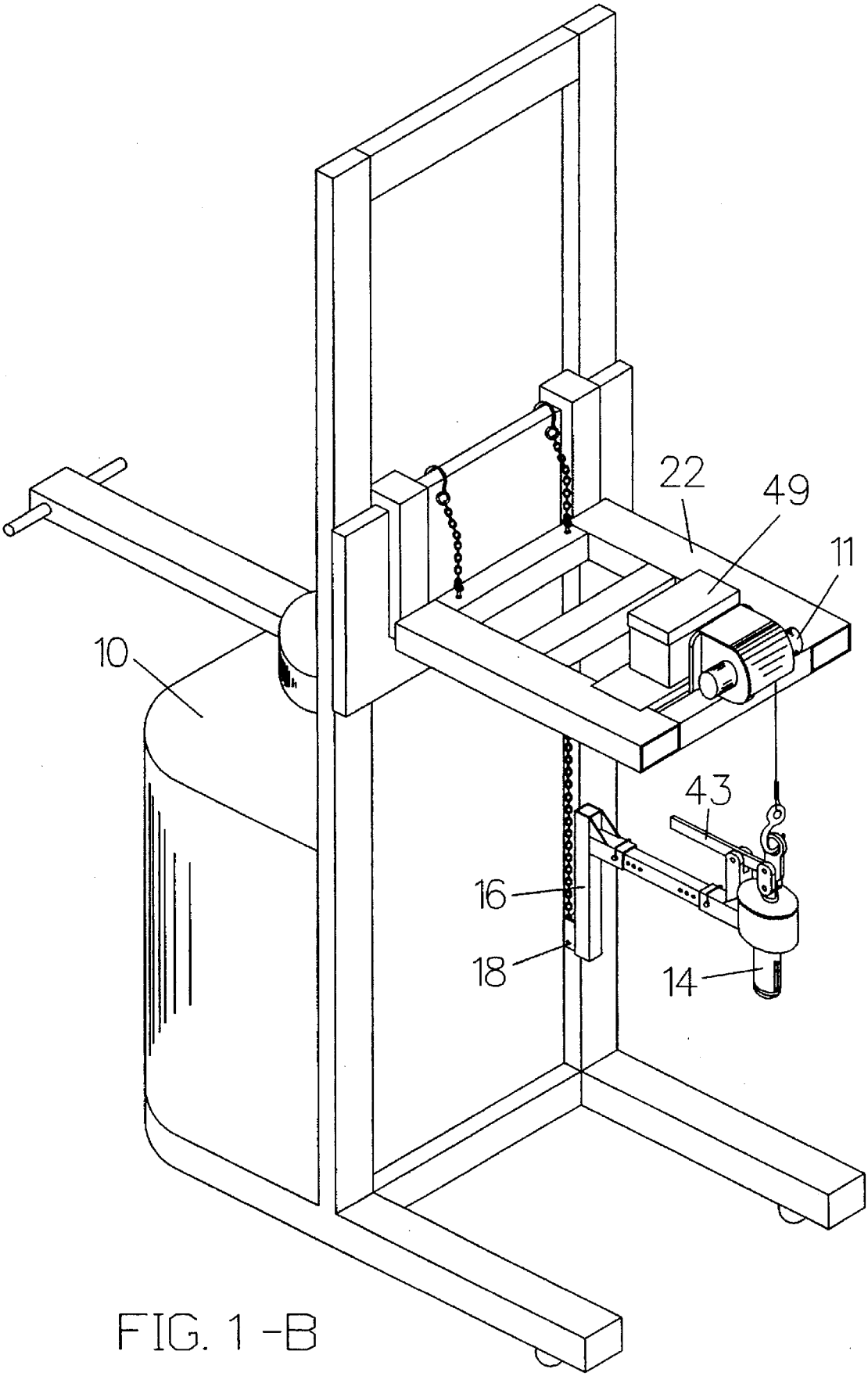
FIG. 1-B

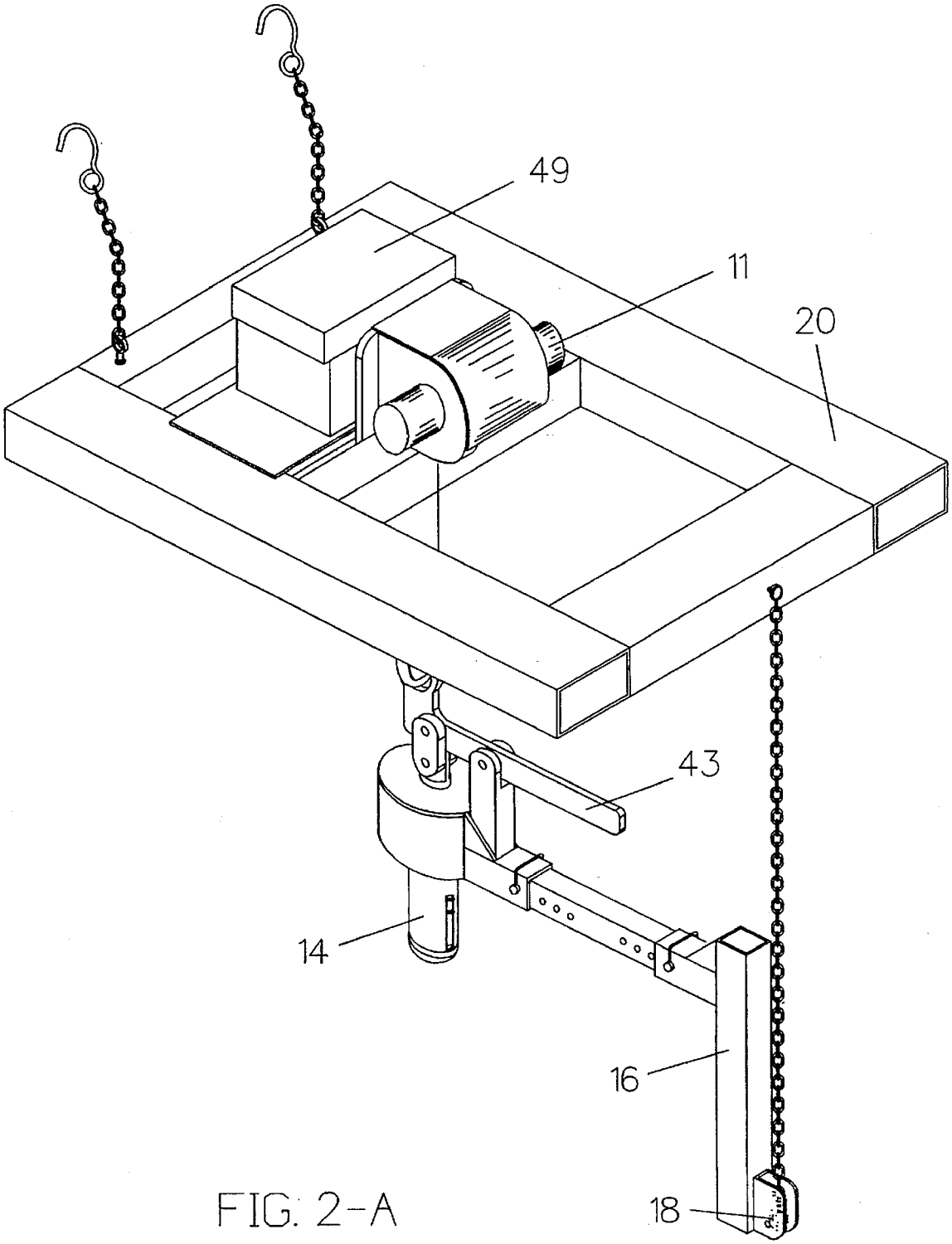
FIG. 2-A

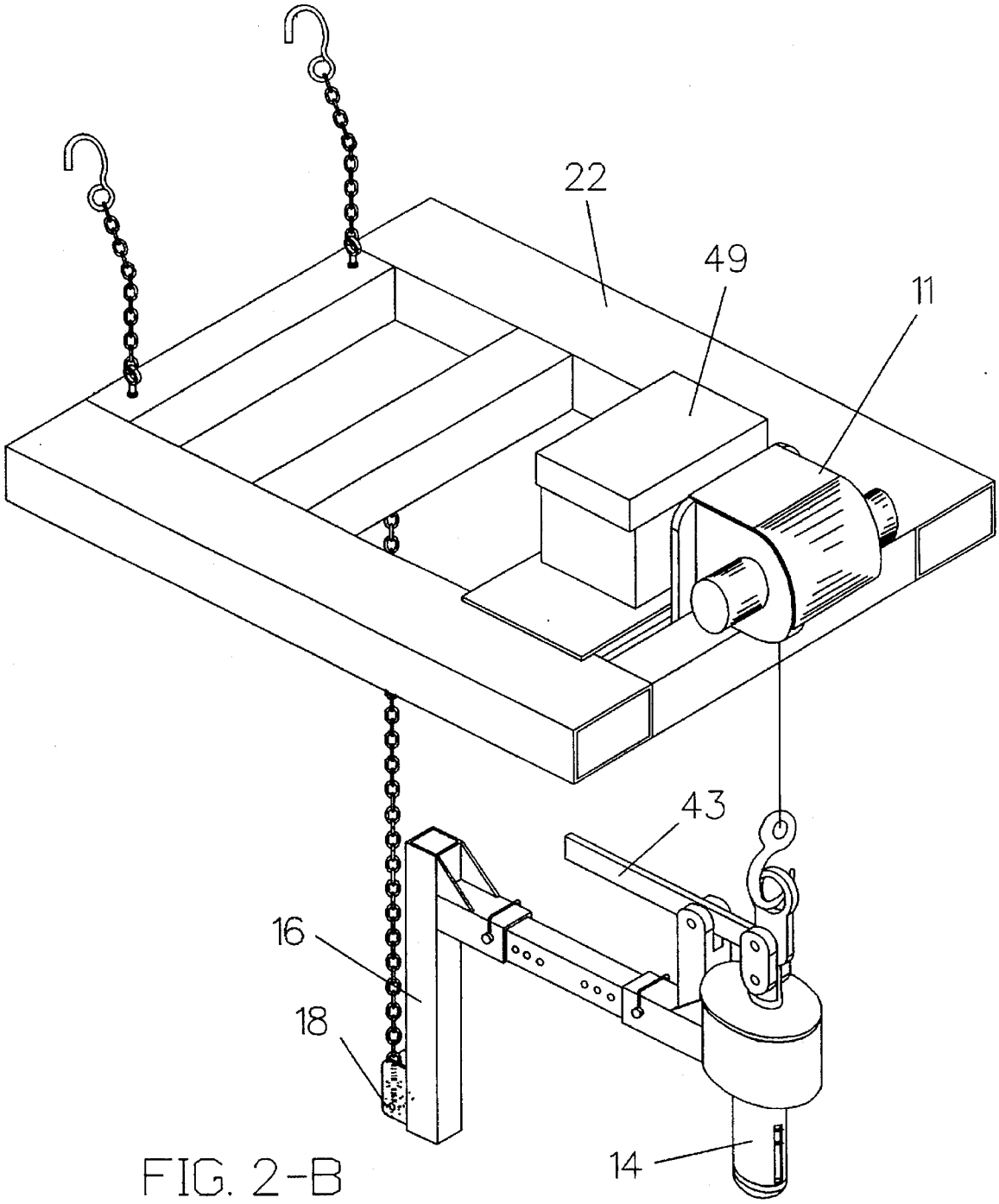
FIG. 2-B

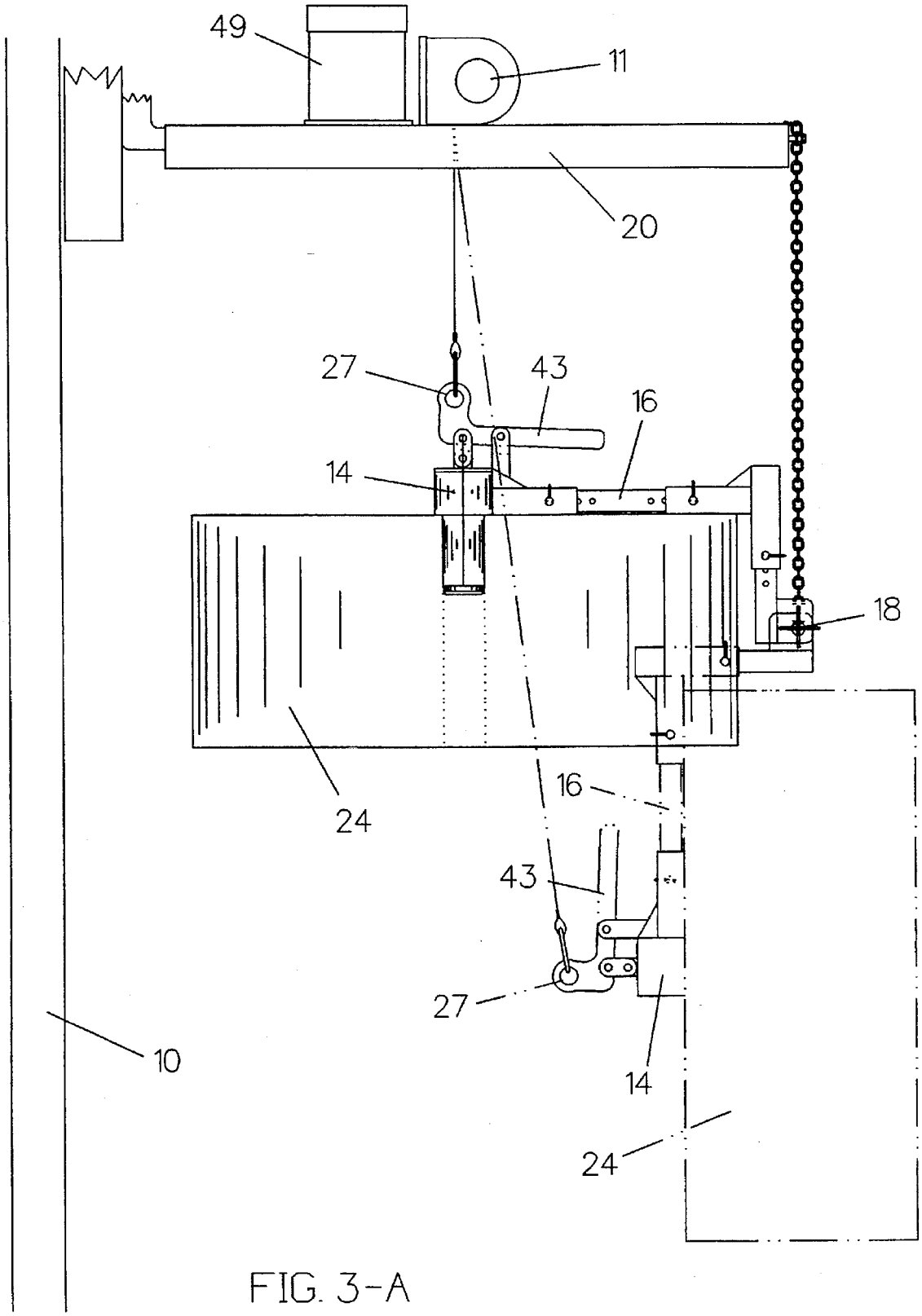
FIG. 3-A

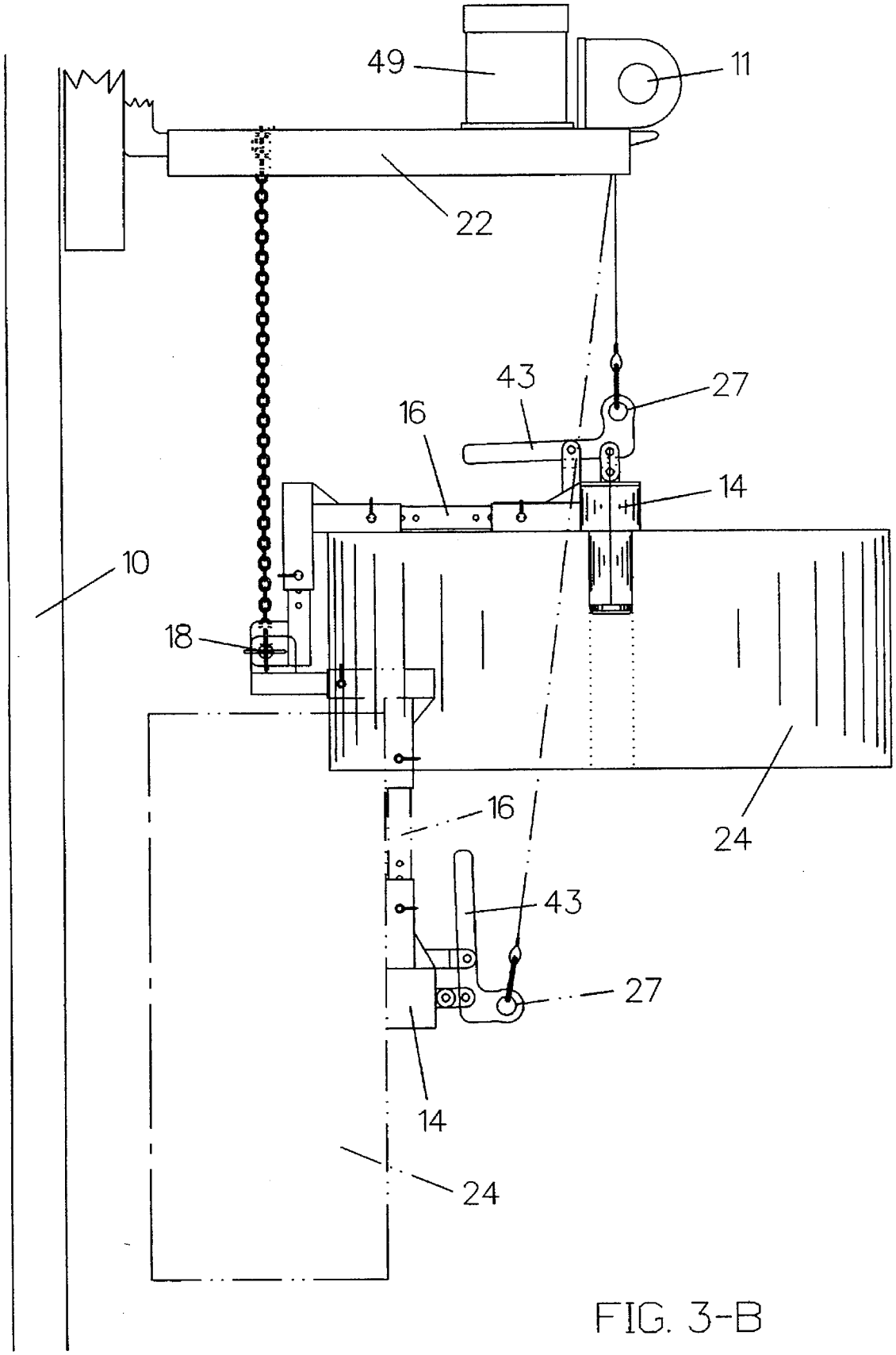
FIG. 3-B

ROLL HANDLING APPARATUS FOR FORK LIFT TRUCKS

CROSS REFERENCES TO RELATED APPLICATIONS

This application is a Continuation In Part Application of application Ser. No. 08/370,370 filed Jan. 9, 1995 titled Roll Handling Apparatus for Fork Lift Trucks issued as U.S. Pat. No. 5,513,944 issued May 7, 1996, and includes significant improvements for operation and safety.

BACKGROUND—FIELD OF INVENTION

The invention relates to an apparatus that converts a typical fork lift truck to a roll lifting, turning, and transporting vehicle in a method that revolutionizes a known use of such a truck. See FIG. no. 1A or 1B.

Buildings being built today, often times, are not structurally designed to suspend heavy overhead cranes for conveying rolls and coils of materials used in production facilities. Also, many older buildings are encumbered with overhead electrical, plumbing, heating, and similar obstacles. Such obstacles restrict or prohibit the use of overhead cranes for conveying rolls and coils in a plant. Our fork lift truck roll handling apparatus will make the manufacture of products using paper, film, plastic, foil, and similar materials in roll form far more efficient, particularly in such plants.

In addition a fork truck system, such as ours, that is flexible and easy to engage a roll of material with will be found much more convenient to use than other types available.

The improvements discussed in this CIP application will further increase the efficiency of the operator because of the self contained power supply, and will also provide greater safety because of the load sensing brake in the hoist.

BACKGROUND—DESCRIPTION OF PRIOR ART

Patents that have been granted for handling rolls or conveying rolls of material wound on cores rely on overhead stacker, bridge, jib, and similar overhead cranes. Such approaches to handling rolls and coils are limited to the overhead environment of a given manufacturing facility. One such patent has been issued to Herbert F. Dalglish, U.S. Pat. No. 4,154,470. Three other related patents by the same inventor are U.S. Pat. Nos. 3,758,144, 3,734,328, and 3,730,368. One other known patent is by one of the inventors of this disclosure Ralph E. Cullen, U.S. Pat. No. 4,358,143. This patent relates to the above patents and provides the added feature of ease of transfer of a roll of material from a lifting device to a cantilever shaft.

One other device on the market today combines a rigidly mounted center lift that is rotatable, with a fork lift, and is sold as a complete machine. The operator must locate the lift truck in perfect alignment with the roll core in order to insert the center lift or proper engagement is not possible. When not done properly, product damage occurs or it becomes a time consuming truck maneuvering problem leading to a non-functioning purchase.

Another company has available a rigidly mounted center lifting device that can rotate a roll of material. This device is built as an attachment to a fork lift truck, but again has the disadvantage of being rigid and difficult to align the center lift with the material core. In addition these two devices require the roll center of gravity to always be beyond the ends of the forks. This dictates the use of a larger, higher capacity fork lift truck.

OBJECTS AND ADVANTAGES

Accordingly, several objects and advantages of our invention are that it is suited to a fork lift truck vehicle that is already found in most, if not all, manufacturing plants. Our invention does not require the dedicated use of a fork lift truck either, but is easily and quickly attached to or removed from the truck forks as daily roll handling requirements dictate. Our invention, the fork lift truck roll handling apparatus is a positive, practical and unique alternative to the required installation or use of overhead cranes.

The Cullen/Sjolund invention, the fork lift truck roll handling attachment, slides on to any typical set of forks, and with power from an included battery/charger pack or a simple power connection to the truck battery, enables the truck operator to lift, turn, and transport rolls of material.

Another very important and cost saving feature with the Cullen/Sjolund invention, the fork lift truck roll handling attachment, is that it offers true horizontal positioning on any roll or coil of material. The Herbert F. Dalglish device, U.S. Pat. No. 4,154,470, using a one point suspension from an overhead crane and chain, will always cause the outer edge of a roll or coil to sustain much of the material weight load when initially lifting or lowering to or from the floor. It has been found that many of these materials are too expensive and sensitive and cannot tolerate such pivotal pressure contact.

Another advantage of the Cullen/Sjolund invention, over and above other fork truck related units is the flexibility of the suspension of the center lift from the base frame. This allows the truck operator to be less than perfect when seeking alignment between the center lift and the core of material. This speeds up the operation and reduces operator frustration.

Another advantage is included in one of the improvements in this CIP apparatus which is the ease of disengagement from the roll and the firm gripping of the roll at all angles of suspension provided by the lever and pivot mechanism now added to the top of the center lift.

There is no need to install an overhead crane system for handling rolls within the parameters of our invention. This reduces the investment required substantially. And to reiterate, this will be the answer for those who occupy buildings that do not have appropriate ceiling structure strength to support an overhead crane system or for those who have overhead obstacles prohibiting that option.

Still further objects and advantages will become apparent from a consideration of the ensuing description and accompanying drawings.

BRIEF DESCRIPTION OF THE DRAWINGS

FIG. 1-A is a perspective view of our invention as typically mounted on a walking stacker type fork lift in the "hoist in" version.

FIG. 1-B is a perspective view of our invention mounted on a typical walking stacker in the "hoist out" version.

FIG. 2-A is a perspective view of the invention itself in the "hoist in" version.

FIG. 2-B is a perspective view of the invention itself with the hoist in the "hoist out" position.

FIG. 3-A is a 2 dimensional view of the invention with the hoist in the "hoist in" position shown with a roll both vertical and horizontal. This figure demonstrates how the roll of material rotates about a pivot at the lower end of the fixed length suspension chain.

FIG. 3-B is a 2 dimensional view of the invention with the hoist in the "hoist out" position shown with a roll both vertical and horizontal. This figure demonstrates how the roll of material rotates about a pivot point at the lower end of the fixed length suspension chain.

REFERENCE NUMERALS

Figure 4:
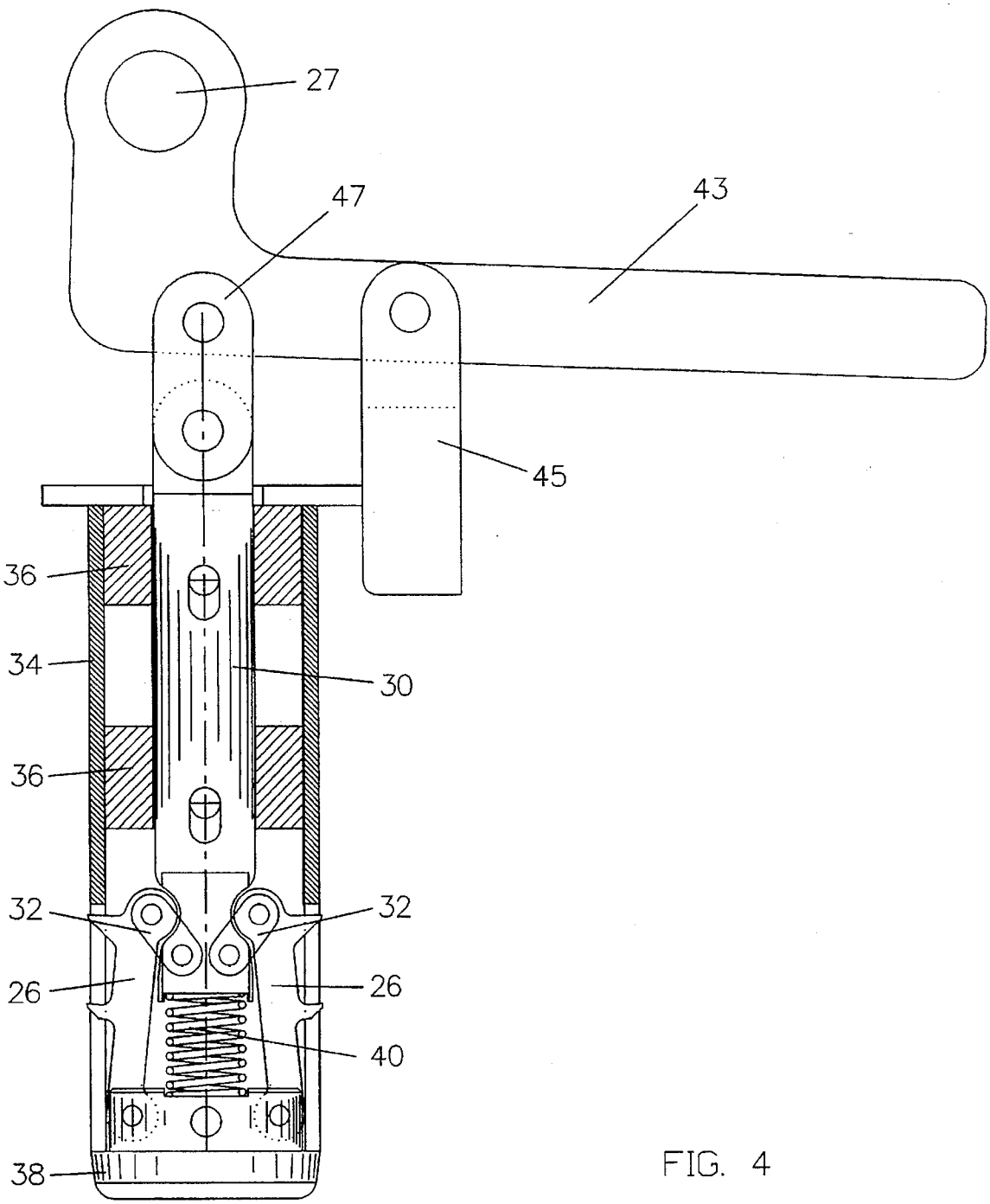
FIG. 4 is a cross-sectional view of the roll center lift device when in the disengaged mode.

10 fork lift truck
11 hoist
14 roll center lift
16 "L" shaped arm
18 pivot pin
20 base frame A
22 base frame B
24 roll of material
26 gripper
27 lifting eye
30 lifting shaft
32 linkage
34 housing 34
36 linear bearing
38 nose piece
40 spring
43 lifting lever
45 lever pivot base
47 lifting link
49 battery/charger power pack

SUMMARY

Our invention is designed to convert any fork lift truck to a roll turning and transporting truck by sliding our apparatus onto the forks of the truck and safely attaching it with safety chain to the fork carriage. Raising or lowering the apparatus is provided by the fork lift system. Our apparatus provides for the lifting and turning of the roll of material. The apparatus includes a horizontal rectangular frame constructed of rectangular steel tubing, including four or more such tubular members of varying size as shown in FIGS. 1A and 1B, welded together to form a base. An electric hoist, with load sensing brake, mounted on the base frame is the source of motion, and power is obtained from the battery/charger pack, or fork lift batteries, through an electric cable. Control is through a switch box and an umbilical cord connected to the hoist motor. The hoist cable is connected to a roll center lift probe which is assembled as a part of an "L" shaped arm that is also pivotally attached to the base frame through the use of a chain. Lifting of a roll of material is made possible by the cable from the hoist and a chain connected to the base frame. The fork lift is driven to a location approximately over the core of a roll of material where the operator can lower the forks and manually slip the probe into the core. Precise location is not required because of the flexible attachment of the probe to the base frame. The probe will engage itself with the core and grip it firmly. As the fork lift is activated to raise the roll, the apparatus is also raised lifting the roll of material. The roll of material can then be turned from vertical to horizontal rotating about a pivot point at the lower end of the suspension chain by activating the hoist such that the cable is extended until the roll reaches the horizontal position. Lifting a roll that is horizontally positioned and turning it to the vertical position is also possible with this apparatus. During the lifting and rotating of the roll, the cable is always lifting through its attachment to the lifting eye. This attachment to the lifting eye transfers the cable force to the lifting lever and from there through the lifting link it forms an axial force on the lifting shaft. This is accomplished regardless of the angle between the cable and the lifting shaft, assuring a continuous gripping force on the core.

PREFERRED EMBODIMENT—DESCRIPTION

The Cullen/Sjolund invention, FIG. 2-A or 2-B, consists of a rectangular horizontal base frame A 20 or base frame B 22 incorporating a power D.C. hoist 11, a roll center lift 14, with lifting lever 43, suspended from the hoist 11 cable, and an "L" shaped arm 16 that projects out from the roll center lift 14 connecting to a fixed length chain at its lower point. The lower end of the chain is connected to a pivot pin 18. Pivot pin 18 is located in the leg of the "L" arm 16 which can have a fixed length as shown in FIGS. 1 and 2 or a variable length such as shown in FIG. 3.

FIG. 1-A illustrates our invention in the "hoist in" version mounted on a typical walking stacker type of fork lift truck 10. As shown, the truck has become a roll turning vehicle. The horizontal base frame A 20 of our invention is mounted directly on the forks of the truck and is safely attached, using a safety chain, to the truck carriage. Power for our invention is supplied by either a battery/charger power pack 49 or the batteries of the fork lift truck through a cable and receptacle. The reason for this connection is to operate the roll turning hoist 11. The fork lift truck 10 is used to provide up and down motion of our invention as well as transporting the material within the plant. The hoist 11 is used to rotate the roll of material 24 from vertical to horizontal or the reverse.

FIG. 1-B illustrates our invention in another "hoist out" version as mounted on a typical fork lift truck 10. This version uses horizontal base frame B 22. The description is the same as above only the operation turns the roll in the opposite direction.

FIG. 2-A illustrates our invention itself in the "hoist in" version. The horizontal base frame A 20 of the invention is constructed of rectangular steel tubing and steel plate. It is electrically welded together to form a shape that adapts to typical fork lift truck forks. A chain is suspended from the frame in a way such that its length can be changed for different roll handling situations but during operation it remains fixed. The lower end of the chain is attached to the "L" shaped arm 16 with a pivot pin 18. Hoist 11 is mounted on a steel plate welded to the base frame A 20. The hoist 11 cable is attached to roll center lift 14 through lifting lever 43 and operates in harmony with the chain to suspend the roll of material 24.

FIG. 2B illustrates our invention itself in the "hoist out" version. This version uses base frame B 22 and operates in the opposite direction relative to the direction the roll of material 24 faces.

FIGS. 3A & 3B illustrate in two dimensions, the operation of the invention in roll turning. They show the extending of the of the cable from hoist 11 and the turning of the roll of material 24 about pivot pin 18. The vertical position is shown in standard lines and the horizontal position is shown in ghosted lines.

FIG. 4 illustrates, in detail, the parts included in the roll center lift 14 in the gripper 26 retracted position. The roll center lift 14 is built of many parts. Starting from the top the lifting eye 27 on the lifting lever 43 provides the attachment point for hoist 11 through a cable and hook. Lifting eye 27 on lifting lever 43 pivots about lever pivot base 45 and is connected to lifting shaft 30 through lifting link 47, and both linkage 32 parts are loosely pinned to it. The other end of linkage 32 parts are loosely pinned to gripper 26 parts. The device housing 34 is the cylindrical cover and the linear bearings 36 are there to guide the motion of the lifting shaft 30. The nose piece 38 of the roll center lift 14 supports the linkage base pins, with a spring 40 to apply pressure to the grippers 26 in the engaged position direction.

Figure 5:
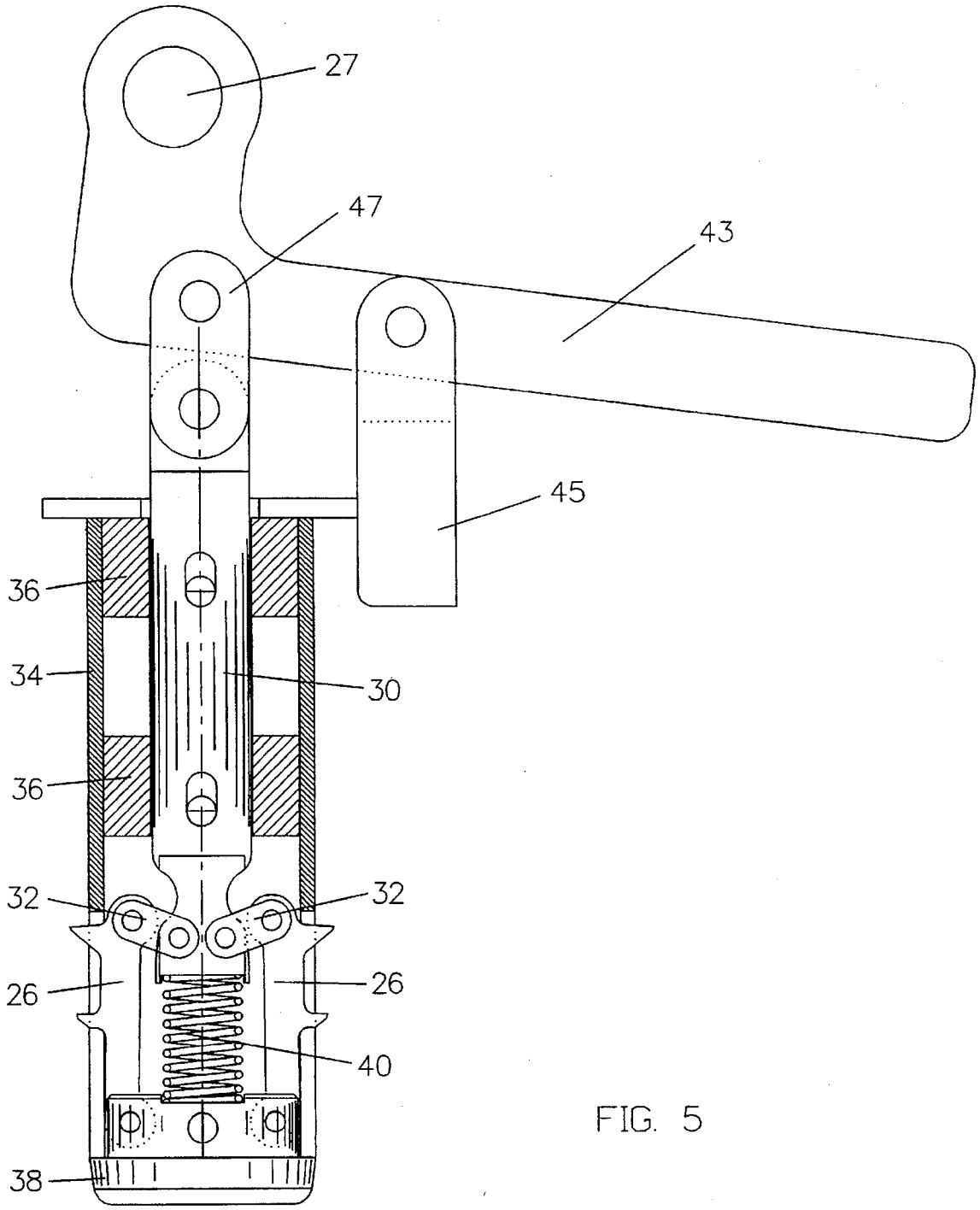
FIG. 5 is a cross-sectional view of the roll center lift when actuated and during lift operation.

FIG. 5 illustrates, in detail, the parts included in the roll center lift 14 in the gripper engaged position. All parts and descriptions are the same as in the paragraph above.

PREFERRED EMBODIMENT—OPERATION

FIGS. 1-A & 1-B illustrate the operation possibilities of our invention in conjunction with a fork lift truck 10. The fork lift truck 10 is used to get up and down motion while our invention is used to get rotary motion of the roll of material 24. A typical use of our invention would be to drive the fork lift truck 10 over to a pallet supporting rolls of material. The forks, with our invention installed will be at a height high enough so the complete device will clear the rolls. At this point the truck will be steered such that the roll center lift 14 will be generally over the core I.D. of the roll of material 24 to be lifted. The flexibility of our invention now shows its advantage when the roll center lift 14 can be lowered and manually guided into the core I.D. without perfect alignment of the fork lift truck 10. The roll center lift 14 is slipped into the roll core, and if necessary the lifting lever 43 release handle of the roll center lift 14 can be raised to permit the easiest entry. As the forks of the fork lift truck 10 are raised, the grippers 26 of the roll center lift 14 will dig into the core engaging it firmly and permitting the fork lift truck 10 to lift the roll of material 24. The center lift 14 is designed such that the heavier the roll of material is the firmer the grip will be. Lifting a roll of material 24 that is in the horizontal position can also be accomplished with ease. In this case the hoist 11 is activated to get the center lift 14 into the horizontal position. Then the center lift 14 is inserted into the core of the roll of material 24 while holding pressure on the lifting lever 43 to retract the grippers 26. With the center lift 14 engaged, the fork lift truck 10 can be caused to raise the forks raising our invention and the roll of material 24 in the horizontal position. In this position the lever 43 shows its improvement over the original design shown in application Ser. No. 08/370,370 in that the force in the lifting cable from hoist 11 is transfered to the lifting shaft 30 through lifting lever 43 and the force becomes an axial force causing engagement of the grippers 26 while causing no side load or friction on the lifting shaft 30. The roll of material 24 can now be turned to vertical safely with the grippers 26 holding firmly and the disengagement of the center lift 14 being accomplished with ease.

FIGS. 2-A & 2-B illustrate the same function as FIG. 1-A & 1-B but with a close up view.

FIGS. 3-A & 3-B illustrate the rotary motion of the roll of material 24 as provided by our invention. The forks are raised to a height which will permit the roll to be turned without the roll edge hitting the floor.

FIG. 3-A shows the "hoist in" version of the invention. Hoist 11 cable is in the retracted position and the roll of material 24 in the vertical position. As the change is made from cable retracted to cable extended position the "L" shaped arm 16, with roll of material 24, will rotate about the pivot pin 18 at the lower end of the suspension chain. During this rotation the axial force applied to the lifting shaft 30 will remain proportional to the force in the lifting cable and be continuous. This is accomplished because the lifting lever 43 is supported by the lever pivot base 45 and must rotate about its pin. The roll of material 24 can be stopped during rotation when the roll reaches a true horizontal position, and the bottom of the roll of material 24 will now be facing away from the fork lift truck 10. In this position the roll of material 24 can be placed by a printing or converting machine in a correct mode for production unwinding.

FIG. 3-B shows the "hoist out" version of the invention. The operation is the same as in the first version, however the roll of material 24 bottom ends up facing the fork lift truck 10. Obviously a unit could be built to rotate the roll of material 24 from side to side or in other directions as well.

In both FIGS. 3-A & 3-B the adjustability of the "L" shaped arm 16 is shown. The "L" shaped arm 16 can be extended or retracted to accomodate various diameters of roll of material 24. The "L" shaped arm 16 leg length can also be changed to accomodate different widths of rolls by removing the pin in the leg and extending or shortening the leg. This changes the location of the pivot pin 18 relative to the center of gravity of the roll of material 24. The center of gravity must be on the cable side of the pivot pin 18 in order for the apparatus to work. Either a fixed length leg on the "L" shaped arm 16 as shown in FIG. 1 and FIG. 2 can be used, or a variable length leg such as the one shown in FIGS. 3-A & 3B can also be used if different roll widths must be accomodated.

FIGS. 4 and 5 illustrate the operation of the roll center lift 14. FIG. 4 shows the cross-sectional view of roll center lift 14 when the grippers 26 are disengaged. This is the position of the internal parts when the roll center lift 14 is slipped into the core of a roll. This position is achieved automatically by insertion into a core or by raising the release handle of the lifting lever 43 and overcoming the spring 40. To achieve an engagement with the core, one only needs to start to lift the roll with the lifting cable attached to the lifting eye 27 shown at the top of the device. As the lifting shaft 30 rises it will start to rotate linkages 32 and thereby rotate grippers 26 which penetrate the core firmly engaging it and permitting the roll of material 24 to be lifted.

OTHER EMBODIMENTS

Electric Actuator, Linear or Rotary—Description

Numerous types of linear or rotary electric actuators are commercially available that could be used to lower or raise the roll center lift. We have chosen the hoist because of its low cost, long stroke, and the built in safety factor of having a load sensing brake.

Electric Actuator, Linear or Rotary—Operation

A standard A.C., D.C., or stepper motor driven actuator could be used in conjunction with a system of levers and cables to increase the stroke. This operation would not be as convenient, but could replace the hoist.

Pneumatic or Hydraulic Actuator—Description

Pneumatic, hydraulic, electro-pneumatic, or electro-hydraulic actuators are commercially available that could be used to lower or raise the eye of the center lift.

Pneumatic or Hydraulic Actuator—Operation

Pneumatic, Hydraulic, electro-pneumatic, or electro-hydraulic actuators could be used directly or indirectly through cables or levers to provide the required motion to rotate the roll of material. Again the expense is a major deterent.

Other Various Center Lift Designs—Description

We will not propose other center lift designs, but many are available, and many more could be designed. Many of these designs could be used directly, Other Various Center Lift Designs—Operation There are many commercially available designs, some that are self energizing like ours and others that must be actuated manually or with some outside source of power.

Conclusions, Ramifications, and Scope

Accordingly, it can be seen that our invention has significant advantages over all previous art. Our invention has a major advantage in its flexibility when approaching the core of material therefore not requiring perfect alignment. The invention also provides readily, a true horizontal position of the roll of material. It also is economical, not requiring a committed fork lift truck or over head bridge system for a crane.

Although the description above contains many specificities, these should not be construed as limiting the scope of the invention but as merely providing illustrations of some of the presently preferred embodiments of this invention. Various other embodiments and ramifications are possible within its scope. For example, the invention could also be a part of a dedicated machine or it could use other electric, pneumatic, or hydraulic means of actuation rather than the chosen hoist. Also the hoist could use chains instead of cables and cables instead of chains, or ropes could be used in all locations. Ramifications like these are possible within the scope of this invention.

Thus the scope of the invention should be determined by the appended claims and their legal equivalents, rather than by the examples given.

What is claimed is:

1. An apparatus for lifting and rotating a roll of material having an accessible axial core opening, comprising:

a rectangular frame comprised of four or more frame members of varying size welded together and designed to fit onto the forks of a conventional fork lift truck, each member comprising a rectangular tube;

an "L" shaped arm;

a probe having first and second ends, the first end constructed for insertion into the core opening of a said roll and including gripping means comprising expansion means for expanding and gripping the inside of the core opening, said second end being connected to said arm;

a first flexible vertical support means having first and second ends and being pivotally connected to a pivot point on said arm at said first end of said support means and connected to said frame at said second end of said support means;

a second flexible vertical support means having first and second ends, said second end of said second support means being connected to said probe through a pivoting lever that assures that an axial force is applied to the probe during lifting and turning;

control and power means connected to said frame and operatively connected to said first end of said second support means to permit controlled extension and retraction of the second support means to thereby provide for rotation of a handled said roll from vertical to horizontal or the reverse;

wherein said control and power means comprises an electric hoist, and said first support means comprises a chain.

* * * * *